US005096095A

United States Patent [19]

Burton

[11] Patent Number: 5,096,095

[45] Date of Patent: * Mar. 17, 1992

[54] DOOR BEVERAGE DISPENSER

[76] Inventor: John E. Burton, 4 Woodland Dr., Pittsburgh, Pa. 15228

[ * ] Notice: The portion of the term of this patent subsequent to Jan. 15, 2008 has been disclaimed.

[21] Appl. No.: 565,272

[22] Filed: Aug. 9, 1990

Related U.S. Application Data

[63] Continuation-in-part of Ser. No. 280,697, Dec. 6, 1988, Pat. No. 4,984,717.

[51] Int. Cl.[5] ..... B67D 1/00

[52] U.S. Cl. ..... 222/173; 222/402.14; 222/402.25; 222/529; 222/146.6; 62/338

[58] Field of Search ..... 222/173, 183, 402.1, 222/402.14, 402.25, 394, 464, 509, 529, 146.6; 251/149.6, 149.7; 62/337, 338, 339, 389; 239/456, 457

[56] References Cited

U.S. PATENT DOCUMENTS

| | | | |
|---|---|---|---|
| 954,320 | 4/1910 | Megget . | |
| 1,055,648 | 3/1913 | Murphy . | |
| 1,958,938 | 5/1934 | Bohandy | 261/19 |
| 2,117,271 | 5/1938 | Bowman | 226/62 |
| 2,160,501 | 5/1939 | Hedges et al. | 225/1 |
| 2,255,280 | 9/1941 | Colvit | 62/337 |
| 2,274,409 | 2/1942 | Harbison | 62/141 |
| 2,297,814 | 10/1942 | Taymans et al. | 62/141 |
| 2,512,395 | 6/1950 | Sundberg | 62/338 |
| 2,747,775 | 5/1956 | Pritchard | 222/400.7 |
| 3,195,779 | 7/1965 | Nicko | 222/146.6 |
| 3,236,418 | 2/1966 | Dalle et al. | 222/394 |
| 3,251,574 | 5/1966 | Hansen | 251/149.7 |
| 3,314,578 | 4/1967 | La Mura | 222/402.25 |
| 3,462,063 | 8/1969 | McGee | 229/14 |
| 3,476,295 | 11/1969 | Telfer | 222/183 |
| 3,556,171 | 1/1971 | Gangwisch | 141/3 |
| 3,599,833 | 8/1971 | Reichenberger | 222/23 |
| 4,124,076 | 11/1978 | Howard | 169/30 |
| 4,162,029 | 7/1979 | Gottsegen | 222/131 |
| 4,265,376 | 5/1981 | Skidell | 222/189 |
| 4,531,656 | 7/1985 | Nitchman | 222/131 |
| 4,623,075 | 11/1986 | Riley | 222/95 |
| 4,678,101 | 7/1987 | Nitchman | 222/82 |
| 4,757,920 | 7/1988 | Harootian et al. | 222/146 |
| 4,984,717 | 1/1991 | Burton, Jr. | 222/183 |

FOREIGN PATENT DOCUMENTS

| | | |
|---|---|---|
| 1446338 | 8/1976 | United Kingdom . |
| 2117657 | 10/1983 | United Kingdom . |

*Primary Examiner*—H. Grant Skaggs
*Attorney, Agent, or Firm*—Ingersoll Buchanan

[57] ABSTRACT

A door dispenser for pressurized liquids utilizes a container having a single resealable passageway for filling, pressurizing and emptying the container. A tube extends from the container to a fitting that with check valves passes through the door nozzle on the outside of the door. Thus, a chilled carbonated or non-carbonated liquid may be dispensed from a container on the inside of the refrigerator door without opening the door.

17 Claims, 5 Drawing Sheets

DOOR BEVERAGE DISPENSER

CROSS REFERENCE TO RELATED APPLICATION

This application is a continuation-in-part of U.S. patent application Ser. No. 280,697, filed Dec. 6, 1988, which issued as U.S. Pat. No. 4,984,717 on Jan. 15, 1991.

FIELD OF THE INVENTION

The present invention relates to a door dispenser for dispensing beverages and other fluids under pressure.

BACKGROUND OF THE INVENTION

A number of containers have been developed for holding and dispensing carbonated beverages and other liquids, pastes and powders under pressure. Perhaps the most common are carbonated beverage bottles and cans as well as aerosol spray cans. One problem with conventional carbonated beverage bottles and cans is that after the container is opened the pressurized gas escapes causing the beverage to go "flat". Consequently, any carbonated beverage will lose its carbonation if left to stand after the container has been opened. Some bottles are factory refillable. Other bottles and cans are disposable.

The costs of the container, particularly disposable containers, are added to the purchase price of the product. Additionally, the user normally pays a bottle deposit on refillable bottles. Many states also require deposits or fees be paid on disposable containers to discourage littering. Customers then return bottles and cases where the containers have the additional cost of recycling. Many single use disposable beverage containers create major environmental problems of litter, or non-biodegradeable, solid, landfill waste.

There are, of course, large, pressurized containers which have been used for soft drink dispensing machines. These containers have large removable caps or lids for filling rather than filling through a single pressure tight valve. Also, gas pressure in conventional carbonated beverage dispensing machine cans or bottles is supplied through a second can valve from an external source of carbon dioxide. One valve is used for filling the container and the second is used for dispensing the product. These systems are not practical for home use, particularly in conjunction with a household refrigerator.

There is a need for a home beverage dispensing system having a refillable bottle which can be used for pressurized fluids such as carbonated beverages and which will allow the beverage to hold its carbonation after some of the product has been removed from the bottle. There is a need for a reuseable pressurized bottle or can which is refillable at a retail outlet. Use of this type of bottle provides lower manufacturing and production costs, lower packaging costs, requires minimal store shelf space and offers savings resulting from bulk storage, handling, transport and retailing of the products held by the refillable, pressurized bottle or can. Such a container eliminates environmental problems of container deposits, returns, recycling, litter, and solid, landfill waste.

There is also a need for a refillable bottle whose contents are under sufficient pressure so that when a tube is connected to the bottle, the contents of the bottle will be discharged through the tube to a remote location without injecting a propellant into the bottle.

Furthermore, there is a need for a fluid dispensing system which includes a pressurized fluid container carrying a self-contained gas pack from which a discharge tube runs to a dispensing valve on the exterior of a door. Such a system should be adaptable to a household refrigerator.

There is also a need for a refillable, pressurized bottle or can which utilizes but a single valve (unlike two valve carbonated beverage and beverage syrup dispensing system cans) through which filling, pressurizing and dispensing of fluid contents can take place. This both reduces costs and makes possible automatic filling and refilling machines which can fill the bottle or can without disassembling and reassembling the unit.

SUMMARY OF THE INVENTION

I provide a fluid dispensing system for refrigerator doors having at least one refillable pressurized bottle from which a discharge tube runs through the door to a nozzle on the outside of the door.

The present invention provides a refillable bottle or can having a single valve through which the bottle is filled, pressurized and emptied. By removing the cap, the bottle may also be manually filled, then pressurized after the cap is replaced. This bottle preferably is comprised of an inner shell made of blow molded plastic similar to the conventional two liter or three liter soft drink bottles now in the marketplace. There is also an outer shell of metal, hard plastic or other reinforcing material attached to the inner shell for reinforcement. The bottle or can may also be fabricated of aluminum, coated steel, stainless steel, or other material suitable to contain the fluid contents. The container has a single, push type, basket valve mounted in the cap which an external probe may engage for filling and to which a nozzle or tube can be connected for emptying the bottle. The valve is provided with openings of sufficient size to permit rapid filling and discharge of the bottle. Preferably, a 2 liter bottle should be able to be filled and pressurized in 30 seconds or less. The contents of the bottle should be under sufficient pressure from a self-contained gas pack to force those contents through a dip tube and valve when this valve is open. Consequently, no propellant need be added to my refillable bottle after filling to discharge the contents. But, I prefer to pressurize the bottle with an external gas source to 60 p.s.i. A discharge tube is engaged to the valve for emptying the bottle. The discharge tube runs from the bottle, through a door, to one of a range of appropriate nozzles. Such nozzles include spray nozzles, a diffuser-type nozzle to retain carbonation in the liquid dispensed, and open nozzles for foaming or discharging a liquid stream of the dispensed fluid.

I prefer to provide an external frame on the door which surrounds and protects the nozzle. The frame and nozzle assembly, connecting tubing and bottle can be installed at the factory or retrofited by the owner. Indeed, my entire system is suitable as both original equipment or as a retrofit.

Other objects and advantages will become apparent as a present description of the preferred embodiment of the invention proceeds.

DESCRIPTION OF THE PREFERRED EMBODIMENTS

Figure 1:
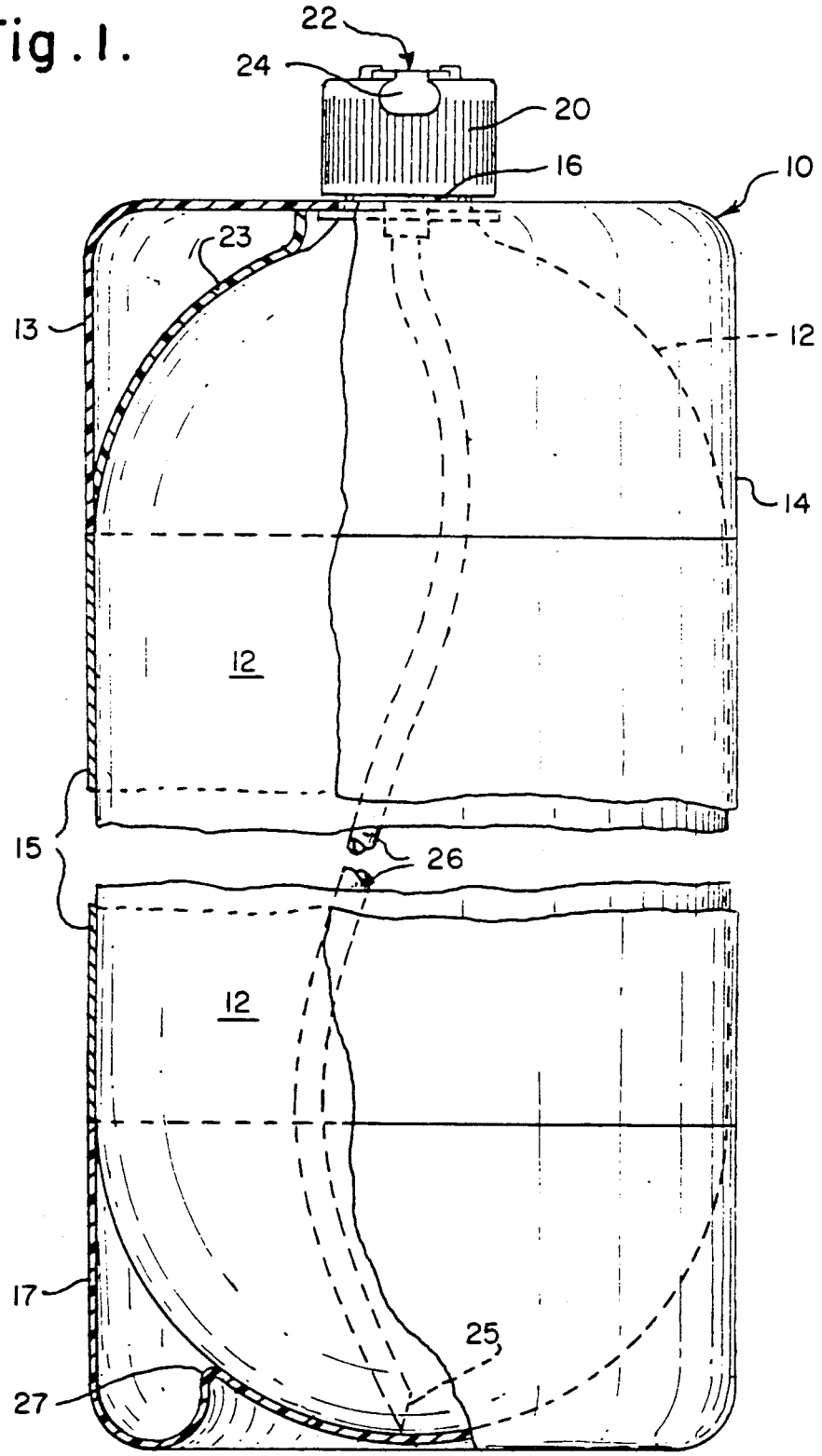
FIG. 1 is a side view, partially in section, of the present preferred reinforced blow molded plastic embodiment of my container.

Referring to FIG. 1, I provide a bottle 10, preferably having an inner shell 12, which is blow molded from plastic in the conventional manner. The shell 12 could also be made from non-corrosive materials such as aluminum, stainless steel or other material which meets FDA standards for food and beverage containers. Alternatively, the entire container could also be fabricated from such materials. Attached to the inner shell is an outer shell 14 which I prefer to make in three pieces. First there is a reinforcing wrap 15 made of a strong plastic or metal, such as stainless steel or aluminum, which is wrapped about the center of the inner shell 12. This reinforcement is applied by cementing the layer to the inner shell. Alternatively, it may be placed in a blow mold when the inner shell is made and attached during molding. I also provide an upper end portion 13 of the outer shell which is attached to the upper portion of the inner shell 12 by cementing or during molding. Finally, there is a lower portion of the outer shell 17 which is similarly made of metal or hard plastic to provide reinforcement. This too can be cemented to the inner shell 12 or made a portion of the inner shell during molding. Because the bottle is designed to withstand both vacuum or negative pressure as well as above atmospheric pressures, I may design the top portion 13 so that it has an inner surface 23 which conforms and attaches to the inner shell 12 as shown in FIG. 1. Similarly, an inner surface 27 is provided on the bottom portion 17 and is attached to inner shell 12 by cementing or during molding. The inner surface 27 of the bottom portion conforms to and covers a substantial part of the bottom of the inner shell. I prefer to provide a conventional mouth 16 having outer threads 18 for receipt of a cap 20. Within the cap I provide a valve 22 having an optional outer lock 24. A sealing ring (not shown) may be placed in the cap to engage and seal the mouth of the bottle. The use of a removable screw cap 20 permits easy cleaning and sterilization of the bottle and cap-dip tube assembly. However, one could easily mold cap 20 to the mouth of the inner shell if desired. Finally, I provide a flexible dip tube 26 which extends from valve 22. The contents of the bottle should be under sufficient pressure to force those contents through the dip tube and valve 22 when the valve is open. Consequently, no propellant need be added to my refillable bottle after filling to discharge the contents. I prefer to terminate the dip tube at an angle 25. Also, tube 26 does not quite reach the bottom of the inner shell so that when the bottle is tipped on its side it will lay against the side. Consequently, I am able to dispense all of the contents of my container when it is either in the vertical position, or in a horizontal position. The dip tube 26 should be made of a flexible material such as rubber or plastic.

Figure 2:
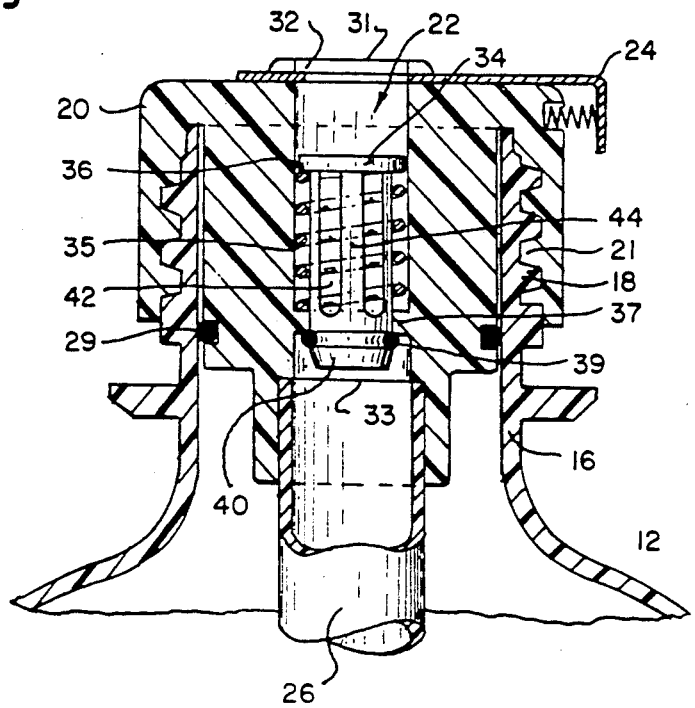
FIG. 2 is a sectional view of the cap and valve portion of the embodiment of FIG. 1.

In FIG. 2, I have shown a present preferred embodiment of the cap and valve arrangement. The cap 20, which can be made of metal or plastic, is preferably molded of plastic to have inner threads 21 which mate with threads 18 on the mouth of the bottle. I also prefer to provide an O-ring seal 29 which seals any gap between the cap and the mouth of the bottle. Within the cap there is a valve 22. This valve consists of a generally cylindrical outer housing 32 with openings 31 and 33. Within housing 32 is a basket 34 which rests on springs 35. This spring is positioned between upper rim 36 of basket 34 and shoulder 37. The basket is closed at its bottom 40, but has a plurality of slots 42 in the side wall 44. Preferably the slots are sized to provide a combined open area of about 0.25 square inches which allows me to fill and pressurize a two liter container to 60 p.s.i. in less than 30 seconds. That container can fill twelve ounce cups in about ten seconds. Furthermore, the valve allows me to dispense the liquid contents of my bottle in a continuous liquid stream rather than a foam or spray. The valve is operated by inserting a probe 50 through which liquid can pass into or from the bottle. When the probe is removed the basket returns to its original position shown in FIG. 2 sealing the gas pressurized bottle. This allows me to dispense a portion of a carbonated beverage from my bottle without destroying or adversely affecting the carbonation of the contents which remain in the bottle. An exterior seal 39 is provided on the lower portion of the basket 34. Dip tube 26 is attached to the cap in any conventional manner such as providing a force fit as shown in FIG. 2. If bottles are being used for several different types of fluids one may make the cap 20, the valve 22, or both, in different sizes. Only one size is used for a given fluid to prevent or discourage the user from filling a bottle with an incorrect or inappropriate fluid. Otherwise, my bottle can be filled and refilled with any liquid and any gas chosen by the user. One may also incorporate a pressure relief valve in the cap.

Figure 3:
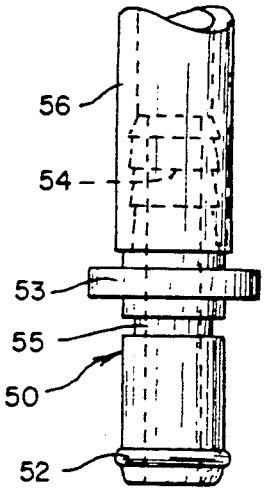
FIG. 3 is a side view of one type of probe which can be inserted into the valve portion of the bottle for filling or dispensing a product.

Turning to FIG. 3 connector fitting 50 is a generally cylindrical tube having an O-ring seal 52 about its lower end. This end is inserted into valve 22 and pushes valve basket 34 (FIG. 2) opening the valve. Seal 52 mates with the inner surface of the valve to prevent liquid from flowing around the outside of the probe. A shoulder 53 is provided on the probe for ease of inserting and removing the probe from the valve. Slot 55 can be engaged by a lock means 24 on the cap (see FIG. 2). A remote tube 56 can be fitted over the opposite end 54 of the probe. This tube can be used for dispensing product from the bottle or filling the bottle. The tube may be attached to the probe in any conventional manner and may be flexible or rigid. I have found that the use of any gas at pressures between 45 p.s.i. and 60 p.s.i. will cause the liquid to be fully dispensed from the bottle. No constricting or measuring devices are required or suggested for my container. Rather, I prefer to have a single valve which allows unrestricted flow to the atmosphere. I have also found that the provision of a concave inner surface on the inner shell will permit the bottle to be used as a carbonator for making carbonated beverages. This is done by filling the bottle up to ⅔ full with a liquid, preferably at a temperature near its freezing point, and then filling the remaining portion of the bottle with carbon dioxide to a pressure between 15 p.s.i. and 60 p.s.i. Next one shakes the container which causes the carbon dioxide to be dispersed throughout the liquid droplets and fog created by the concave surface. The amount of carbonation will depend upon the temperature of the liquid, the degree of agitation, as well as the diffuser used to dispense the liquid. To obtain higher carbonation one may add more gas and shake the container again.

Figure 4:
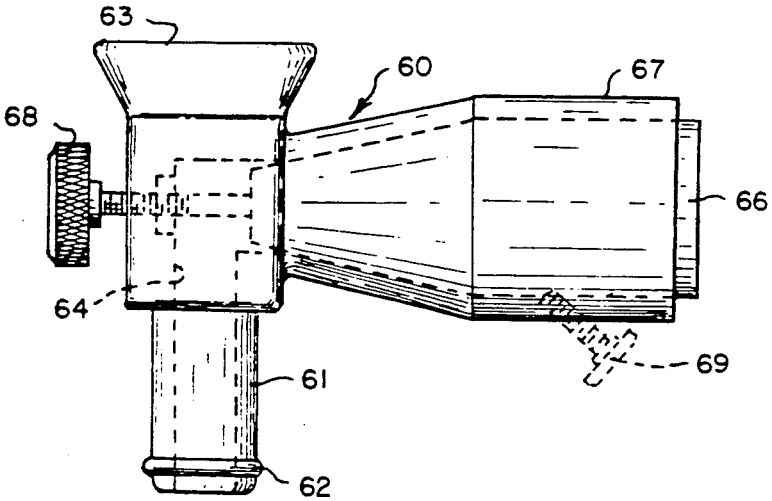
FIG. 4 is a removable diffuser nozzle useful for retaining carbonation in dispensed carbonated beverages which can be inserted into the valve portion of the bottle or connected through a remote connector valve and tubing to a connected fitting inserted into the valve portion of the bottle.

In FIG. 4, I show a carbonation retaining diffuser valve which can be inserted directly or indirectly into valve 22 of the bottle. An indirect connection can be made by inserting a probe with attached flexible tube, such as is shown in FIG. 3, into valve 22. A second valve similar to valve 22 is connected to the distal end of the tube and the diffuser valve is inserted into the remote valve. This diffuser valve 60 has a cylindrical probe-type end 61 with an O-ring seal 62. That end is inserted into valve 22 of the bottle in the same manner as the probe shown in FIG. 3. Fluid then flows from the bottle through valve 22, passageway 64 and nozzle 67. A land 63 on the nozzle allows one to easily push the nozzle into valve 22. A diffuser cone 66 is provided within the nozzle 67 of the diffuser valve. This nozzle cone is moveable relative to the nozzle. Movement is controlled by a hand screw 68 attached to the end of the cone. A seal 65 is provided where the screw enters the nozzle. Alternatively, one could use a screw 69 shown in chain line which passes through the nozzle and connects to the diffuser cone. The screw enables one to control the amount of carbonation in the liquid being dispensed by regulating the clearance or size of opening through which a liquid may flow.

I have found that this bottle is particularly useful for storing and serving all types of carbonated beverages, soft drinks, beer, wine, wine coolers, carbonated and uncarbonated juices and juice drinks. Prior to the present invention the art had not found an affordable single valve bottle, a home dispenser for carbonated beverages which would retain high carbonation in the beverage after the container was opened and some beverage had been removed from the container.

Figure 5:
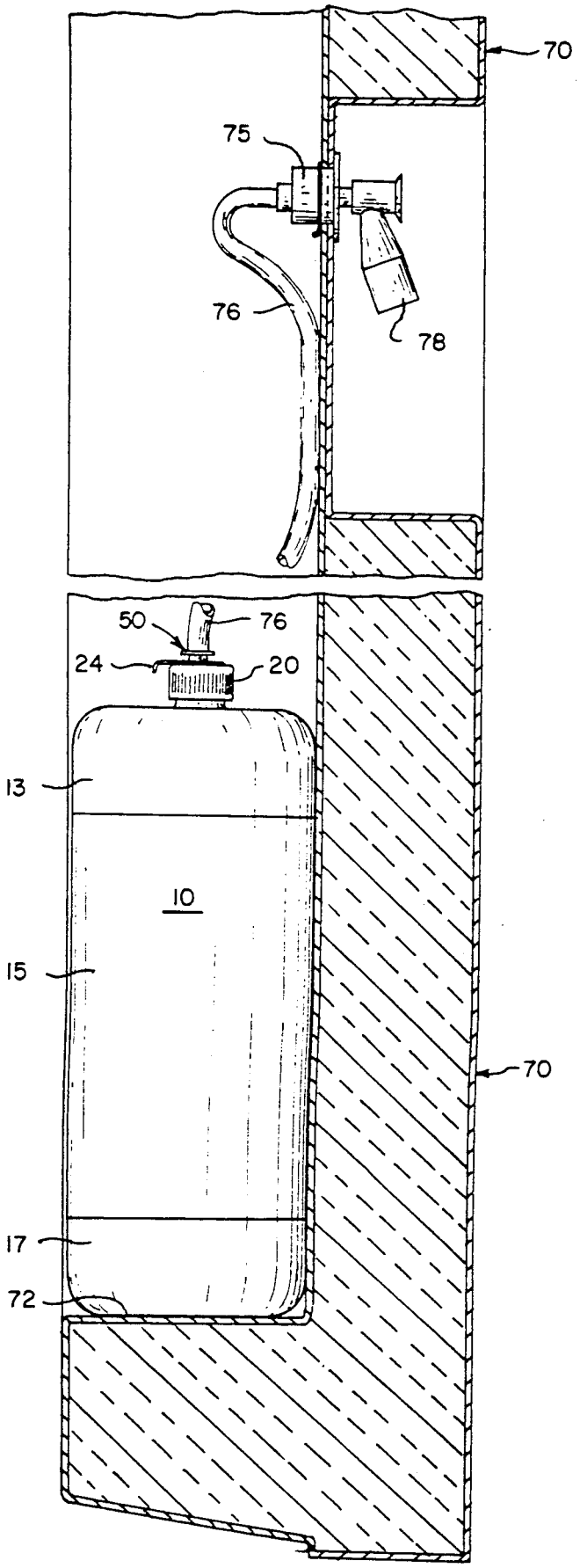
FIG. 5 is an elevational view of the bottle of FIG. 1 placed in a refrigerator door or on a refrigerator shelf and having a hose and remote diffuser attached to the bottle through the door or the side of the refrigerator.

My bottle can be stored vertically or horizontally in a variety of containers including refrigerators, beer and soft drink dispensers, ice chests, cabinets and home bars. In these instances one may provide a delivery tube between the bottle valve 22 and dispensing nozzle. This will permit the product to be removed from the bottle without handling the bottle or opening the refrigerator or other container. In FIG. 5, I show my bottle 10 placed on a shelf 72 horizontally or vertically in a refrigerator or a refrigerator door. A delivery tube 76 extends from a probe 50 which has been inserted into the valve in cap 20 and is locked in place by lock 24. The probe engages and opens valve 22 in bottle 10 which charges tube 76. Tube 76 has a connector 75 which extends through the refrigerator door or side of the refrigerator 70. Preferably, this connector has a valve **75*a* (shown in chain line) in it to prevent liquid from flowing through it if nozzle 78 is not in place. This valve could be similar to that used in my bottle cap which is shown in FIG. 2. Finally, a diffuser nozzle 78 is attached to connector 75. To remove product from bottle 10 one simply opens nozzle 78 by depressing the diffuser 78 into spring loaded valve 75. This can be done without opening the refrigerator door. There is sufficient self contained gas pressure within the bottle to propel all of the fluid from the bottle Preferably, that pressure will be high enough to further propel the liquid through the tube 76 and nozzle 78. When the bottle 10 is empty one simply disconnects probe 50, replaces the empty bottle with a full bottle and inserts probe 50 into the full bottle. Although I have shown my bottle in a refrigerator one could place the bottle on a shelf in any cabinet. Furthermore, several of my pressurized containers could be collectively attached to tube 76 thereby greatly increasing the amount of fluids that may be dispensed through valve 75 and diffuser 78 without refilling or replacing a bottle. To increase the variety of fluid dispensed one can use several arrangements similar to that shown in FIG. 5. One may also add a check valve 50*a* (shown in chain line) to probe 50 which would enable the user to remove the probe 50** before the bottle is discharged and insert it into another bottle.

My bottle can be installed as original equipment in a refrigerator door or retrofited onto a door. In both instances it may be preferable to surface mount the housing and nozzles on the outside of the door. In such an installation I prefer to provide a housing around the nozzles as shown in FIGS. 6 thru 9.

Figure 6:
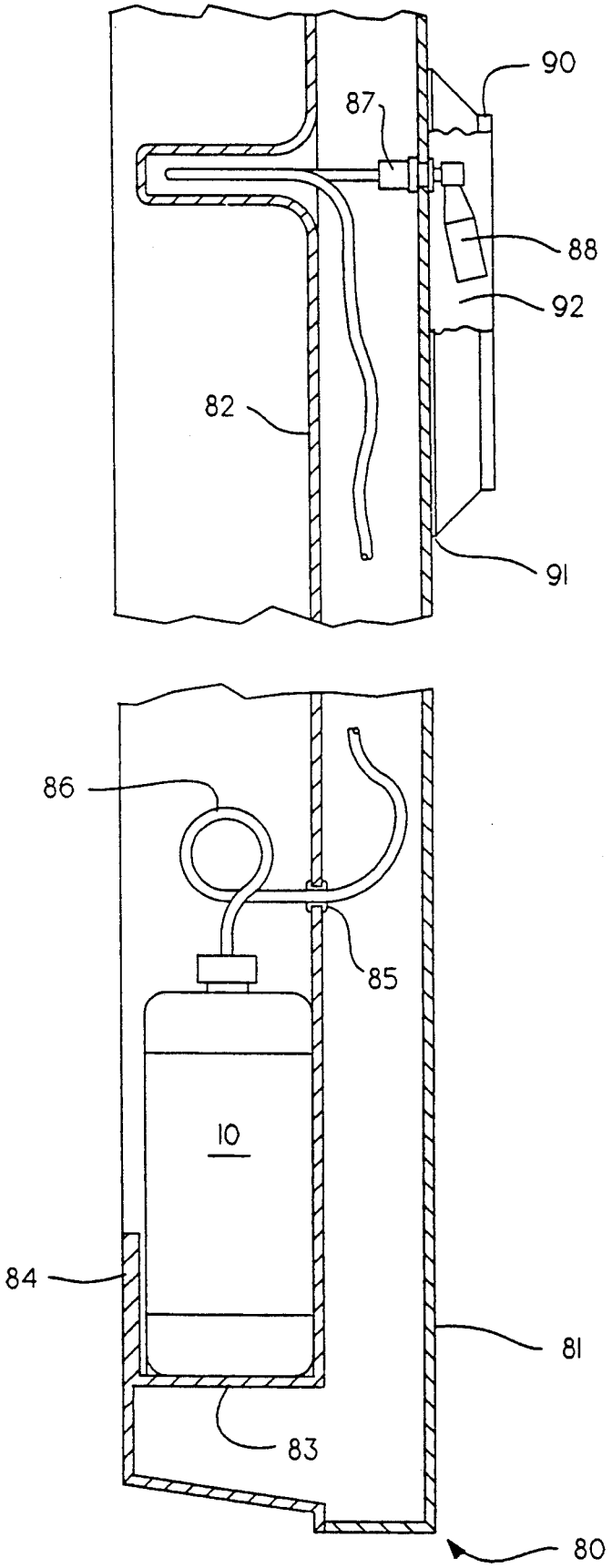
FIG. 6 is an elevational view similar to FIG. 5, showing another preferred embodiment of my system.
Figure 8:
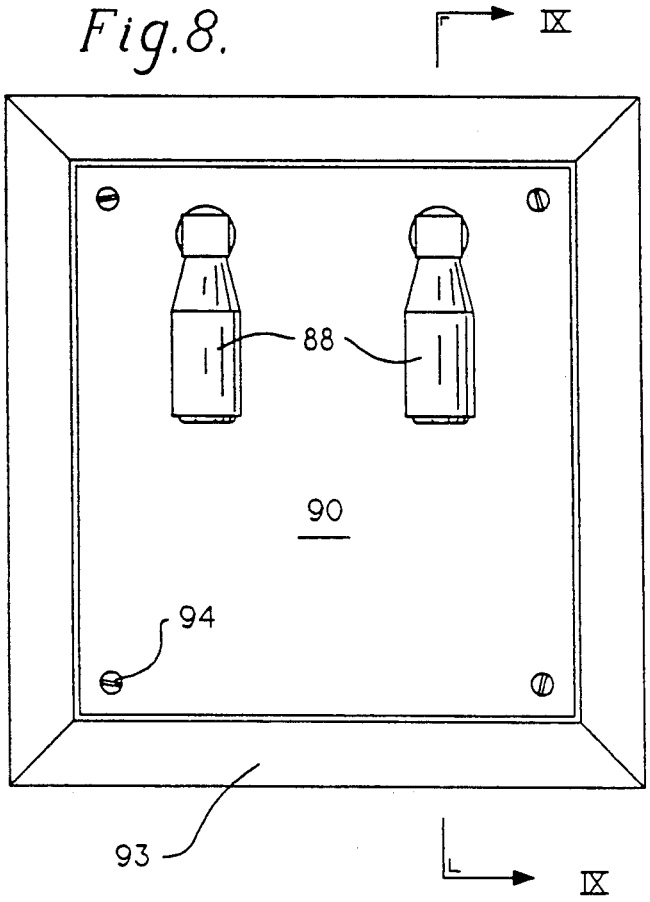
FIG. 8 is a plan view of the nozzles and dispensing panel of the embodiment of FIG. 6.
Figure 9:
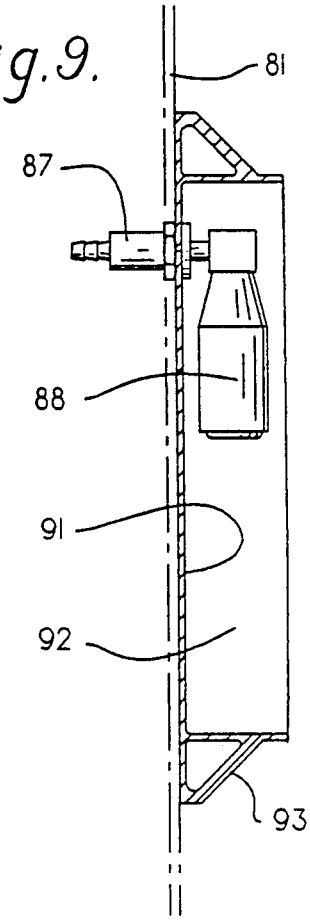
FIG. 9 is a sectional view taken along the line IX—IX of FIG. 8.
Figure 7:
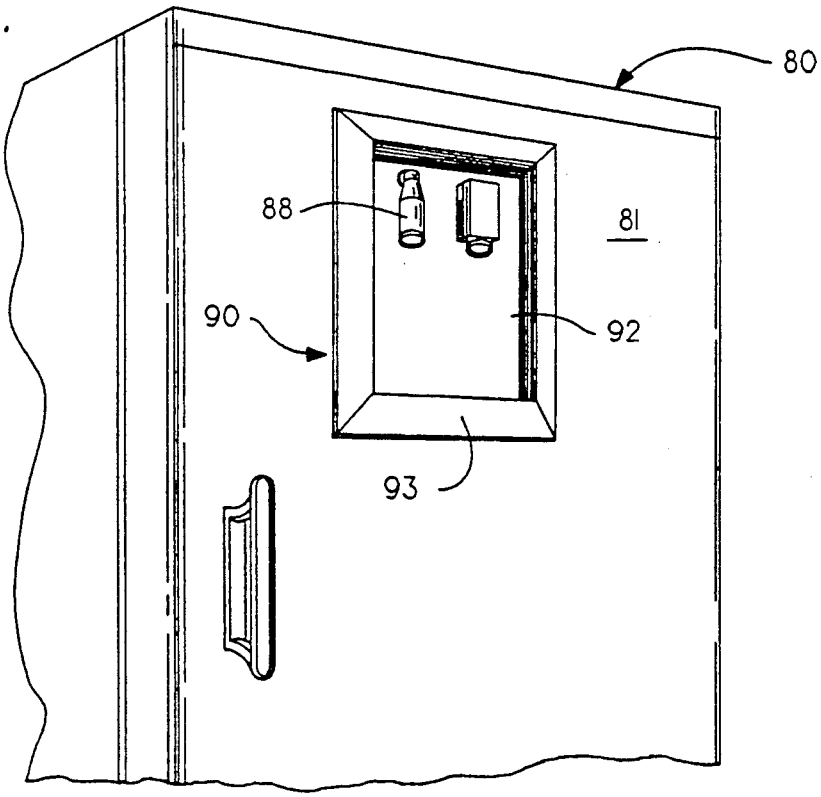
FIG. 7 is a perspective view showing the top half of the front of the refrigerator door in the embodiment of FIG. 6.

The refrigerator door 80, in the embodiments shown in FIGS. 6 and 7, has an outer panel 81 and an inner panel 82. Insulation (not shown) normally is provided between these panels. At least one shelf 83 extends from the inner panel 82 toward the interior of the refrigerator. A guard rail 84 may be provided to prevent objects from falling off shelf 83.

I place at least one of my bottles 10 on shelf 83 on the door. The bottle could also be on a shelf (not shown) inside of the refrigerator. A delivery tube 86 extends from bottle 10 through a grommet 85 in inner panel 82 to a fitting 87 on the inner side of outer panel 81. Fitting 87 extends through outer panel 81 and housing 90 and is sized to accept nozzle 88. Preferably fitting 87 has a spring loaded basket type valve similar to that used in my bottle and shown in FIG. 2. This valve is opened by pushing nozzle 88 into fitting 87. It is not necessary to run tube 86 between panels 81 and 82. One may choose to extend fitting 87 through both panels 81 and 82. In that event tube 86 would remain to the left of the inner panel 82 and be totally inside of the refrigerator.

I prefer to provide a housing 90 on the outside of the door which surrounds nozzles 88. This housing consists of a back plate 91 which is affixed to front panel 81 by adhesive or screws 94 or other attachment means. Sidewalls 92 extend perpendicularly from the back plate 91. The sidewalls preferably have an outer bezel 93. The sidewalls should be wide enough to protect nozzles 88 as shown in FIG. 6. The bezel 93 minimizes the apparent width of the sidewalls.

The dispenser housing 90 shown in FIGS. 6 thru 9 can be made of metal or plastic. Housing 90, nozzles 88, fitting 87, tube 86 and grommet 85 as well as complete bottle assemblies can be sold in kit form for installation on existing refrigerators. All such parts are easy to assemble, clean or replace. Environmental advantages and reduced beverage costs are obvious through eliminating single use throw away beverage cans and bottles.

Nozzles 88 may be any suitable type to deliver carbonated, non-carbonated, or foamed beverages. For carbonated beverages a carbonation retaining diffuser should be provided. The diffuser could be a nozzle 88 as shown in FIG. 4 or in fitting 87 as shown in dotted line as diffuser 87*a*. One could also provide a check valve in fitting 87 or tubing 86 as indicated by check valve 86*a* shown in chain line.

Clearly, my dispenser permits cold beverages to be served without opening and closing the refrigerator door. Therefore, my system substantially reduces energy costs for operating the refrigerator.

While I have shown several present preferred embodiments of the invention, it is to be distinctly understood that the invention is not limited thereto, but may be variously embodied within the scope of the following claims.

I claim:

1. A door dispenser for dispensing pressurized carbonated and non-carbonated liquids contained in a bottle on the inner side of a door from nozzles attached to the outside of the odor comprising:

a. a bottle comprised of a top, a base and at least one wall attached between the top and the base which together define an enclosed space and at least one valve attached to said top said valve having a basket portion comprised of a substantially open top, a bottom and side supports between the top and bottom with passageways therebetween for filling the container with a liquid stream, pressurizing and emptying the container with a liquid stream containing all liquid contents or any portion of said contents of the container, said bottle being sized and constructed so as to be capable of retaining fluids at pressures above atmospheric pressure;

b. a fitting sized to extend through the door, receive a tube at one end and receive a nozzle at the other end;

c. a tube connected between the bottle and the fitting; and d. a nozzle attached to the fitting.

2. The door dispenser of claim 1 also comprising a housing having a back panel for attachment to a flat surface of the door and through which the fitting may pass and sidewalls extending from the back panel, the sidewalls being sized and positioned to encircle the nozzle.

3. The door dispenser of claim 2 wherein the housing is plastic.

4. The door dispenser of claim 2 wherein the sidewalls have an outer bezel.

5. The door dispenser of claim 2 wherein the sidewalls are of sufficient width so that the nozzle is protected by the surrounding sidewalls.

6. The door dispenser of claim 1 also comprising a valve attached to the fitting which opens when the nozzle is pushed toward the fitting.

7. The door dispenser of claim 1 also comprising a check valve attached to at least one of the fitting and the tube.

8. The door dispenser of claim 1 also comprising a carbonation retaining diffuser positioned in one of the fitting and the nozzle.

9. The door dispenser of claim 8 wherein the carbonation retaining diffuser contains a nozzle having a movable cone and attached screw which can be turned to adjust clearance between the nozzle and the cone as liquid is dispensed and bottle pressure drops.

10. The door dispenser of claim 8 also comprising a check valve positioned upstream of the nozzle.

11. The door dispenser of claim 1 wherein the door is of two panel construction having an outer panel and an inner panel with space therebetween, the fitting is sized to fit through the outer panel and receive a tube passing through the space, and also comprising a grommet sized to be attached to the inner panel and to allow the tube to pass through the grommet.

12. The door dispenser of claim 1 also comprising a locking device to hold the probe to the bottle.

13. The door dispenser of claim 1 wherein the tube connected between the nozzle and fitting to bottle passes through an inner door wall, extending to at least one bottle mounted on an inner refrigerator shelf.

14. The door dispenser of claim 1 also comprising a check valve in the tubing.

15. The door dispenser of claim 1 wherein the nozzle is constructed so that the nozzle may be pulled out and removed from fitting without aid of tools.

16. The door dispenser of claim 1 also comprising a housing recessed within the door, the fitting passing through the housing and attached to a nozzle positioned within the housing.

17. A door dispenser for dispensing pressurized carbonated and non-carbonated liquids contained in a bottle on the inner side of a door from nozzles attached to the outside of the door comprising:

a. a bottle comprised of a top, a base and at least one wall attached between the top and the base which together define an enclosed space and at least one valve attached to said top, having a single resealable passageway for filling, pressurizing and emptying the bottle, said bottle being sized and constructed so as to be capable of retaining fluids at pressures above atmospheric pressure;

b. a fitting sized to extend through the door, receive a tube at one end and receive a nozzle at the other end;

c. a tube connected between the bottle and the fitting;

d. a nozzle attached to the fitting; and e. a carbonation retaining diffuser positioned in one of the fitting and the nozzle wherein the carbonation retaining diffuser contains a nozzle having a movable cone and attached screw which can be turned to adjust clearance between the nozzle and the cone as liquid is dispensed and bottle pressure drops.

* * * * *

UNITED STATES PATENT AND TRADEMARK OFFICE

CERTIFICATE OF CORRECTION

PATENT NO. : 5,096,095

DATED : March 17, 1992

INVENTOR(S) : JOHN W. BURTON

It is certified that error appears in the above-identified patent and that said Letters Patent is hereby corrected as shown below:

Column 7, line 29, claim 1, change "odor" to --door--.

Signed and Sealed this

Fifteenth Day of June, 1993

*Attest:*

Michael K. Kirk

MICHAEL K. KIRK

*Attesting Officer*

*Acting Commissioner of Patents and Trademarks*